US006254219B1

(12) United States Patent
Agarwal et al.

(10) Patent No.: US 6,254,219 B1
(45) Date of Patent: Jul. 3, 2001

(54) INKJET PRINTHEAD ORIFICE PLATE HAVING RELATED ORIFICES

(75) Inventors: Arun Agarwal; Timothy Weber, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/038,999

(22) Filed: Mar. 10, 1998

Related U.S. Application Data

(63) Continuation-in-part of application No. 08/805,488, filed on Feb. 25, 1997, which is a continuation-in-part of application No. 08/547,885, filed on Oct. 25, 1995.

(51) Int. Cl.[7] ..... B41J 2/14

(52) U.S. Cl. ..... 347/47; 347/44; 347/45; 347/46; 347/65

(58) Field of Search ..... 347/44, 60, 65, 347/47; 239/60

(56) References Cited

U.S. PATENT DOCUMENTS

| | | | | |
|---|---|---|---|---|
| 4,502,060 | | 2/1985 | Rankin et al. | 346/140 R |
| 4,528,577 | | 7/1985 | Cloutier et al. | 346/140 R |
| 4,550,326 | * | 10/1985 | Allen et al. | 346/140 R |
| 4,773,971 | * | 9/1988 | Lam et al. | 204/11 |
| 5,167,776 | | 12/1992 | Bhaskar et al. | 205/75 |
| 5,194,877 | * | 3/1993 | Lam et al. | 346/140 R |
| 5,255,017 | | 10/1993 | Lam | 346/140 R |
| 5,412,413 | * | 5/1995 | Sekiya et al. | 347/46 |
| 5,443,713 | * | 8/1995 | Hindman | 205/70 |
| 5,560,837 | | 10/1996 | Trueba | 216/27 |
| 5,563,641 | | 10/1996 | Plesinger | 347/47 |
| 5,766,441 | * | 6/1998 | Arndt et al. | 347/47 |
| 5,874,974 | * | 2/1999 | Courian et al. | 347/65 |
| 6,024,440 | * | 2/2000 | Murthy et al. | 347/65 |

OTHER PUBLICATIONS

Recent Progress in Ink Jet Technologies, reprinted from IS&T Proceedings and Journal Articles 1993–1995, "Bubble Ink–Jet Technology with Improved Performance"; Enrico Manini; Ivan Rezanka and Reiner Eschbach, 1996, pp. 177–178.

* cited by examiner

*Primary Examiner*—John Barlow
*Assistant Examiner*—Manish S. Shah
(74) *Attorney, Agent, or Firm*—Raymond A. Jenski

(57) ABSTRACT

A printhead for an inkjet printer utilizes an orifice plate having at least two ink ejection orifices associated with one ink firing chamber so that both orifices eject ink. These orifices are manufactured to be non-circular and opposite each other about a midpoint between them.

15 Claims, 16 Drawing Sheets

SECTION B-B

INKJET PRINTHEAD ORIFICE PLATE HAVING RELATED ORIFICES

This patent is a continuation-in-part of U.S. patent application Ser. No. 08/805,488, "Reduced Spray Inkjet Printhead Orifice", filed on behalf of Arun Agarwal et al. on Feb. 25, 1997 which is a continuation-in-part of U.S. patent application Ser. No. 08/547,885, "Non-Circular Printhead Orifice", filed on behalf of Weber on Oct. 25 1995, each assigned to the assignee of the present invention.

BACKGROUND OF THE INVENTION

The present invention is generally related to an inkjet printer printhead and is more particularly related to a printhead orifice plate and the method for producing same in which multiple related orifices may be easily formed in the orifice plate.

An inkjet printer forms characters and images on a medium, such as paper, by expelling droplets of ink in a controlled fashion so that the droplets land in desired locations on the medium. In its simplest form, such a printer can be conceptualized as a mechanism for moving and placing the medium in a position such that the ink droplets can be placed on the medium, a printing cartridge which controls the flow of ink and expels droplets of ink to the medium, and appropriate control hardware and software. A conventional print cartridge for an inkjet printer comprises an ink containment section, which stores and supplies ink as needed, and a printhead, which heats and expels the ink droplets as directed by the printer control software. Typically, the printhead is a laminate structure including a semiconductor base, a barrier material structure which is honeycombed with ink flow channels, and an orifice plate which is perforated with small holes or orifices arranged in a pattern which allows ink droplets to be expelled.

In one conventional variety of inkjet printer the expulsion mechanism consists of a plurality of heater resistors formed in the semiconductor substrate which are each associated with one of a plurality of ink firing chambers formed in the barrier layer and one orifice of a plurality of orifices in the orifice plate. Each of the heater resistors is connected to the controlling software of the printer such that each of the resistors may be independently energized to quickly vaporize a portion of ink into a bubble which subsequently expels a droplet of ink from an orifice. Ink flows into the firing chamber formed in the barrier layer around each heater resistor and awaits energization of the heater resistor. Following ejection of the ink droplet and collapse of the ink bubble, ink refills the firing chamber to the point where a meniscus is formed across the orifice. The form and constriction in barrier layer channels through which ink flows to refill the firing chamber establish both the speed at which ink refills the firing chamber and the dynamics of the ink meniscus. Further details of printer, print cartridge, and printhead construction may be found in the Hewlett-Packard Journal, Vol. 36, No. 5, May 1985, and in the Hewlett-Packard Journal, Vol. 45, No. 1, February 1994.

One of the problems faced by designers of print cartridges is that of maintaining a high print quality while achieving a high rate of printing speed. When a droplet is expelled from an orifice due to the rapid boiling of the ink inside the firing chamber, most of the mass of the ejected ink is concentrated in the droplet which is directed toward the medium. However, a small portion of the expelled ink resides in a tail extending from the droplet to the surface opening of the orifice. This tail and associated ink spray can land on the medium resulting in a hazy printed image or character. The spray problem has been addressed by reducing the speed of the printing operation or by optimizing the architecture or geometry of the ink firing chamber and the associated ink feed conduits in the barrier layer. Orifice geometries also affect spray, see U.S. patent application Ser. No. 08/608,923, "Asymmetric Printhead Orifice" filed on behalf of Weber et al. on Feb. 29, 1996.

One conventional method of fabricating an orifice plate utilizes an electroless plating technique on a prefabricated mandrel. Such a mandrel is illustrated (not to scale) in FIG. 1, in which a substrate 101 has at least one flat surface constructed of silicon or glass. Disposed on the flat surface of the substrate 101 is a conducting layer 103, generally a film of chromium or stainless steel. A vacuum deposition process, such as the planar magnetron process, may be used to deposit this conductive film 103. Another vacuum deposition process may be used to deposit a dielectric layer 105, which typically is silicon nitride, and is deposed by a vacuum deposition process such as a plasma enhanced chemical vapor deposition process. Dielectric layer 105 is desirably very thin, typically having a thickness of approximately 0.30 um. Dielectric layer 105 is masked with a photoresist mask, exposed to UV light, and introduced into a plasma etching process which removes most of the dielectric layer except for "buttons" of dielectric material in preselected positions on the conductive layer 103. Of course, these positions are predetermined to be the location of each orifice of the orifice plate which is to be created atop the mandrel.

This reusable mandrel is placed into an electroforming bath in which the conducting layer 103 is established as a cathode while a base material, typically nickel, is established as the anode. During the electroforming process, nickel metal is transferred from the anode to the cathode and the nickel (shown as layer 107) attaches to the conductive areas of the conductive layer 103. Since the nickel metal plates uniformly from each conductive plate of the mandrel, once the surface of the dielectric button 105 is reached, the nickel overplates the dielectric layer in a uniform and predictable pattern. The parameters of the plating process, including the time of plating, are carefully controlled so that the opening of the nickel layer 107 formed over the dielectric layer button 105 is a predetermined diameter (typically about 45 um) at the dielectric surface. This diameter is usually one third to one fifth the diameter of the dielectric layer button 105 thereby resulting in the top layer of the nickel 107 having an opening at the inside surface 115 of the orifice plate of diameter d2 which is approximately three to five time the diameter of d1 of the opening which will be the orifice aperture at the outside surface 213 of the orifice plate. At the completion of the electroless plating process, the newly formed orifice plate is removed from the mandrel and gold plated for corrosion resistance of the orifice. Additional description of metal orifice plate fabrication may be found in U.S. Pat. Nos. 4,733,971; 5,167,766; 5,443,713; and 5,560,837, each assigned to the assignee of the present invention.

In ink-jet technology, which uses dot matrix manipulation to form both images and alphanumeric characters, the colors and tone of a printed image are modulated by the presence or absence of drops of ink deposited on the print medium at each target picture element (known as "pixels") of an imaginary superimposed rectangular grid overlay of the image. The luminance continuity-tonal transitions within the recorded image-is especially affected by the inherent quantization effects of using ink droplets and dot matrix imaging. The imaging system can also introduce random or systematic luminance fluctuations, commonly known as graininess-the visual recognition of individual dots with the naked eye. It has been estimated that the unaided human visual system will perceive individual dots until they have been reduced to less than or equal to approximately twenty to twenty-five microns in diameter in the printed image. Therefore, undesirable quantization effects of the dot matrix printing method are reduced in the current state of the art by decreasing the size of each drop and printing at a high resolution. Generally, a 1200 dots per inch ("dpi") printed image looks better to the eye than a 600 dpi image which in turn improves upon 300 dpi, etc. Additionally, undesired quantization effect can be reduced by utilizing more pen colors with varying densities of color (e.g., two cyan ink print cartridges, each containing a different ratio of dye to solvent in the chemical composition of the ink) or containing different types of chemical colorants.

One apparatus for improving print quality is discussed in an article, Bubble Ink-Jet Technology with Improved Performance, by Enrico Manini, Olivetti, presented at IS&T's Tenth International Congress on Advances in Non-impact Printing Technologies, Oct. 30–Nov. 4, 1994, New Orleans, La. Manini shows a concept for, "better distributing the ink on the paper, by using more, smaller droplets . . . utiliz[ing] several nozzles for each pressure chamber, so that a fine shower of ink is deposited on the paper." Sketches are provided by Manini showing two-nozzle pressure chambers, three-nozzle chambers, and four-nozzle chambers. Additional improvements to multi-nozzle (or multi-orifice) technologies are disclosed in U.S. patent application Ser. No. 08/812,385, "Method and Apparatus for Improved Ink-Drop Distribution in Ink-Jet Printing", filed on behalf of Weber et al. on Mar. 5, 1997 and assigned to the assignee of the present invention.

While the advantages of multiple orifices for printing are becoming clear, the techniques for realizing printheads with closely-spaced printing orifices particularly clusters of such orifices-are not well developed. The conventional process of manufacturing multiple orifices employs multiple non-conductive buttons on a conductive substrate mandrel, upon which a nickel or other metal is electrodeposited. Unfortunately, this method does not work well for clustered printing orifices because the limited space between heater resistors and associated firing chambers does not allow individual buttons to form orifices while allowing the orifice plate to be sufficiently thick to meet the architecture design requirements for print performance and the manufacturing requirements of orifice sheet strength and ease of handling.

Summary of the Invention

The present invention encompasses a method of manufacturing a printhead and the printhead apparatus for an inkjet printer. The printhead has an orifice plate with at least two ink ejection orifices operationally associated with each other and disposed opposite each other with a midpoint of distance between them. Each of the two orifices has a geometric area which is symmetrical with the other about the midpoint of distance.

DETAILED DESCRIPTION OF A PREFERRED EMBODIMENT

Figure 2:
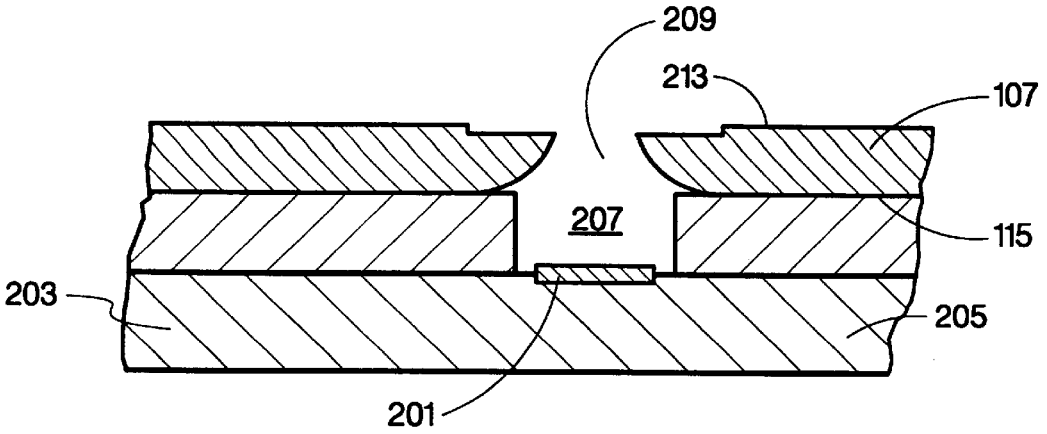
FIG. 2 is a cross sectional view of a conventional printhead showing one ink firing chamber.

A cross section of a conventional printhead is shown in FIG. 2. A thin film resistor 201 is created at the surface of a semiconductor substrate 203 and typically is connected to electrical inputs by way of a metalization (not shown) on the surface of the semiconductor substrate 203. Additionally, various layers offering protection from chemical and mechanical attack may be placed over the heater resistor 201, but are not shown in FIG. 2 for clarity. A layer of barrier material 205 is selectively placed on the surface of the silicon substrate 203 (or less thereon) thereby leaving an opening or ink firing chamber 207 around the heater resistor 201 so that ink may accumulate in the firing chamber prior to activation of heater resistor 201 and ejection of ink through an orifice 209. The barrier material for barrier layer 205 is conventionally Parad® available from E.I. DuPont De Nemours and Company or equivalent material. The orifice 209 is a hole in the orifice plate 107 extending from the inside surface 115 of the orifice plate to the outside surface 213 of the orifice plate and which can be formed as part of the orifice plate as previously described.

Figure 3:
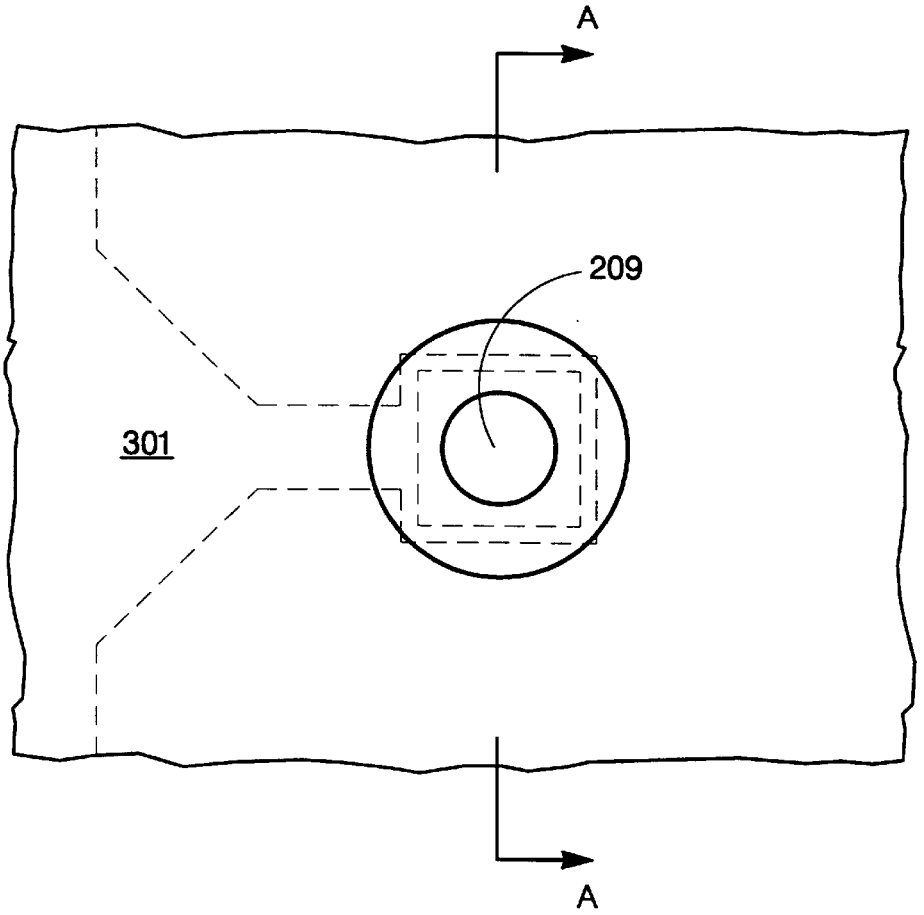
FIG. 3 is a plan view of the outer surface of the orifice plate of a conventional printhead.
Figure 4:
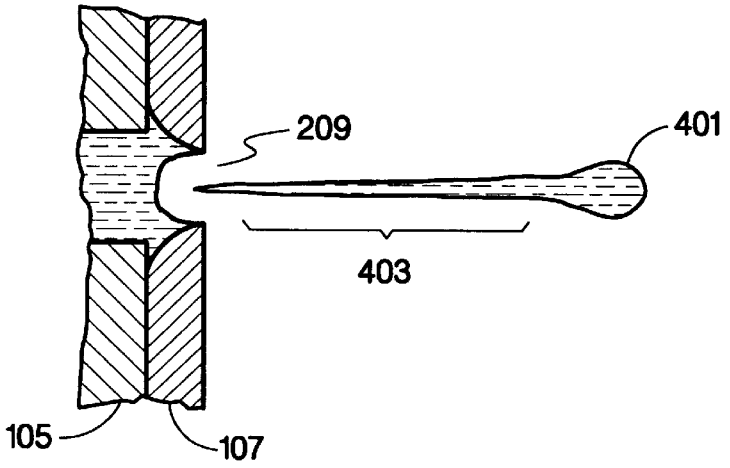
FIG. 4 is a cross sectional view of a conventional printhead illustrating the expulsion of an ink droplet.

FIG. 3 is a top plan view of a conventional printhead (indicating the section A—A of FIG. 2), viewing orifice 209 from the outside surface 213 of the orifice plate 107. An ink feed channel 301 is present in the barrier layer 205 to deliver ink to the ink firing chamber from a larger ink source (not shown). FIG. 4 illustrates the configuration of ink in an ink droplet 401 at a time 22 microseconds after the ink has been expelled from the orifice 209. In conventional orifice plates, (in which circular orifice apertures are used) the ink droplet 401 maintains a long tail 403 which can be seen to extend back to at least the orifice 209 in the orifice plate 107.

After the droplet 401 leaves the orifice plate and the bubble of vaporized ink which expelled the droplet collapses, capillary forces draw ink from the ink source through the ink feed channel 301. In an underdamped system, ink rushes back into the firing chamber so rapidly that is overfills the firing chamber 207, thereby creating a bulging meniscus. The meniscus then oscillates about its equilibrium position for several cycles before settling down. Extra ink in the bulging meniscus adds to the volume of an ink droplet should a droplet be expelled while the meniscus is bulging. A retracted meniscus reduces the volume of the droplet should the droplet be expelled during this part of the cycle. Printhead designers have improved and optimized the damping of the ink refill and meniscus system by increasing the fluid resistance of the ink refill channel. Typically this improvement has been accomplished by lengthening the ink refill channel, decreasing the ink refill channel cross section, or by increasing the viscosity of the ink. Such an increase in ink refill fluid resistance often results in slower refill times and a reduced rate of droplet ejection and printing speed.

Figure 5:
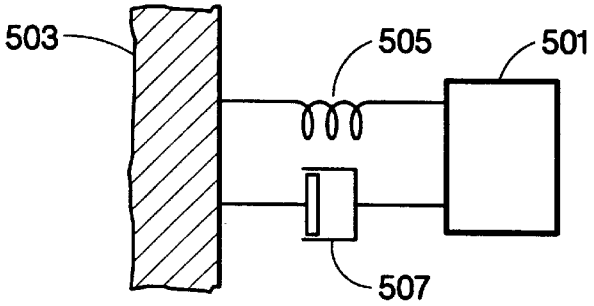
FIG. 5 is a theoretical model of the droplet-meniscus system which may be useful in understanding the performance of the present invention.

A simplified analysis of the meniscus system is one such as the mechanical model shown in FIG. 5, in which a mass 501, equivalent to the mass of the expelled droplet, is coupled to a fixed structure 503 by a spring 505 having a spring constant, K, proportional to the reciprocal of the effective radius of the orifice. The mass 501 is also coupled to the fixed structure 503 by a damping function 507 which is related to the channel fluid resistance and other ink channel characteristics. In the present configuration, the drop weight mass 501 is proportional to the diameter of the orifice. Thus, if one desires to control the characteristics and performance of the meniscus, one may adjust the damping factor of the damping function 507 by optimizing the ink channel or adjusting the spring constant of spring 505 in the mechanical model.

When the droplet 401 is ejected from the orifice most of the mass of the droplet is contained in the leading head of the droplet 401 and the greatest velocity is found in this mass. The remaining tail 403 contains a minority of the mass of ink and has a distribution of velocity ranging from nearly the same as the ink droplet head at a location near the ink droplet head to a velocity less than the velocity of the ink found in the ink droplet head and located closest to the orifice aperture. At some time during the transit of the droplet, the ink in the tail is stretched to a point where the tail is broken off from the droplet. A portion of the ink remaining in the tail is pulled back to the printhead orifice plate 107 where it typically forms puddles of ink surrounding the orifice. These ink puddles, if not controlled, degrade the quality of the printed material by causing misdirection of subsequent ink droplets. Other parts of the ink droplet tail are absorbed into the ink droplet head prior to the ink droplet being deposited upon the medium. Finally, some of the ink found in the ink droplet tail neither returns to the printhead nor remains with or is absorbed in the ink droplet, but produces a fine spray of subdroplets spreading in a random direction. Some of this spray reaches the medium upon which printing is occurring thereby producing rough edges to the dots formed by the ink droplet and placing undesired spots on the medium which reduces the clarity of the desired printed material.

It has been determined that the exit area of the orifice aperture 209 to the external environment defines the drop weight of the ink droplet expelled. It has further been determined that the restoring force of the meniscus (constant K in the model) is determined in part by the proximity of the edges of the orifice aperture. Thus, to increase the stiffness of the meniscus, the sides and opening of the orifice bore hole should be made as close together as possible. This, of course, is in contradiction to the need to maintain a given drop weight for the droplet (which is determined by the exit area of the orifice). A greater restoring force on the meniscus provided by the non-circular geometry causes the tail of the ink droplet to be broken off sooner and closer to the orifice plate thereby resulting in a shorter ink droplet tail and significantly reduced spray.

Some non-circular orifices which may be utilized to reduce spray are elongated apertures having a major axis and a minor axis, in which the major axis is of a greater dimension than the minor axis and both axes are parallel to the outer surface of the orifice plate. Such elongate structures can be rectangles and parallelograms or ovals such as ellipses and parallel-sided "racetrack" structures. Using the ink contained in a model number HP51649A print cartridge (available from Hewlett-Packard Company) and orifice aperture areas equal to the area of the orifice aperture area used in the HP51649A cartridge, it was determined that ellipses having major axis to minor axis ratios of from 2 to 1 through 5 to 1 demonstrated the desired meniscus stiffening and short tail ink droplet ejection.

Figure 6A:
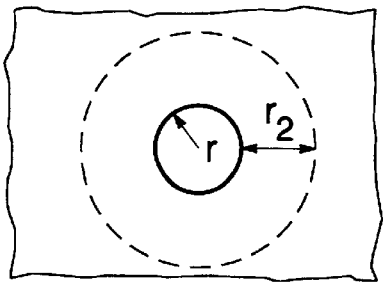
FIGS. 6A and 6B are plan views from the outside surface of the orifice plate showing orifice surface apertures.
Figure 6B:
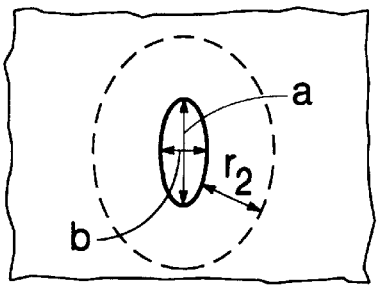

FIGS. 6A–6B are plan views of the orifice plate outside surface illustrating the various types of orifice bore hole dimensions. FIG. 6A illustrates a circular orifice having a radius r at the outer dimension and a difference in radius between the outer dimension r and the opening to the firing chamber of value $r_2$. In the HP51649A cartridge, r=17.5 $\mu$m and $r_2$=45 $\mu$m. This yields an aperture area at the orifice plate outer surface ($r^2 \cdot \pi$) of 962 $\mu m^2$. FIG. 6B illustrates an ellipsoidal outside orifice aperture geometry in which the major axis/minor axis ratio equals 2 to 1 and, in order to maintain an equal droplet drop weight, the outer area of the orifice opening is maintained at 962 $\mu m^2$. Thus, from the formula for the area of the ellipse ($A=\pi \cdot a \cdot b$), the major and minor axes (a, b) of the ellipse are respectively 28.5 $\mu$m and 12.4 $\mu$m for the 2:1 ellipse.

As suggested above, the major contributing factor to the better tail break-off and subsequent spray reduction is the reduction of the size of the minor axis of the ellipse. Within the range of axis ratios of 2:1 to approximately 5:1, reduction of spray is observed. One drawback, which was also noted above, is that elliptic orifice surface openings have a corresponding larger opening at the interior surface of the orifice plate (at the ink firing chamber). These interior openings will overlap and interfere when the orifices are spaced closely together for improved print resolution. This interference takes the form of ink from one firing chamber being blown into an adjacent firing chamber and other subtle but detrimental effects.

In order to resolve the interference problem, the ellipse has been distorted in the major axis direction, to create, in essence, a crescent or quarter moon shape. The minor axis dimension is preserved and the effective major axis is shortened with this crescent shape while the overall orifice aperture area remains constant. Appropriate spray reduction continues to be achieved using a crescent orifice opening shape. The crescent shape, however, introduces a different problem into the quality of print realized with this form of printhead. The trajectory of the ink droplets leaving the orifice plate is not perpendicular to the orifice plate surface but is tilted away from perpendicularity toward the direction of the negative radius of curvature surface of the orifice aperture.

Figure 7:
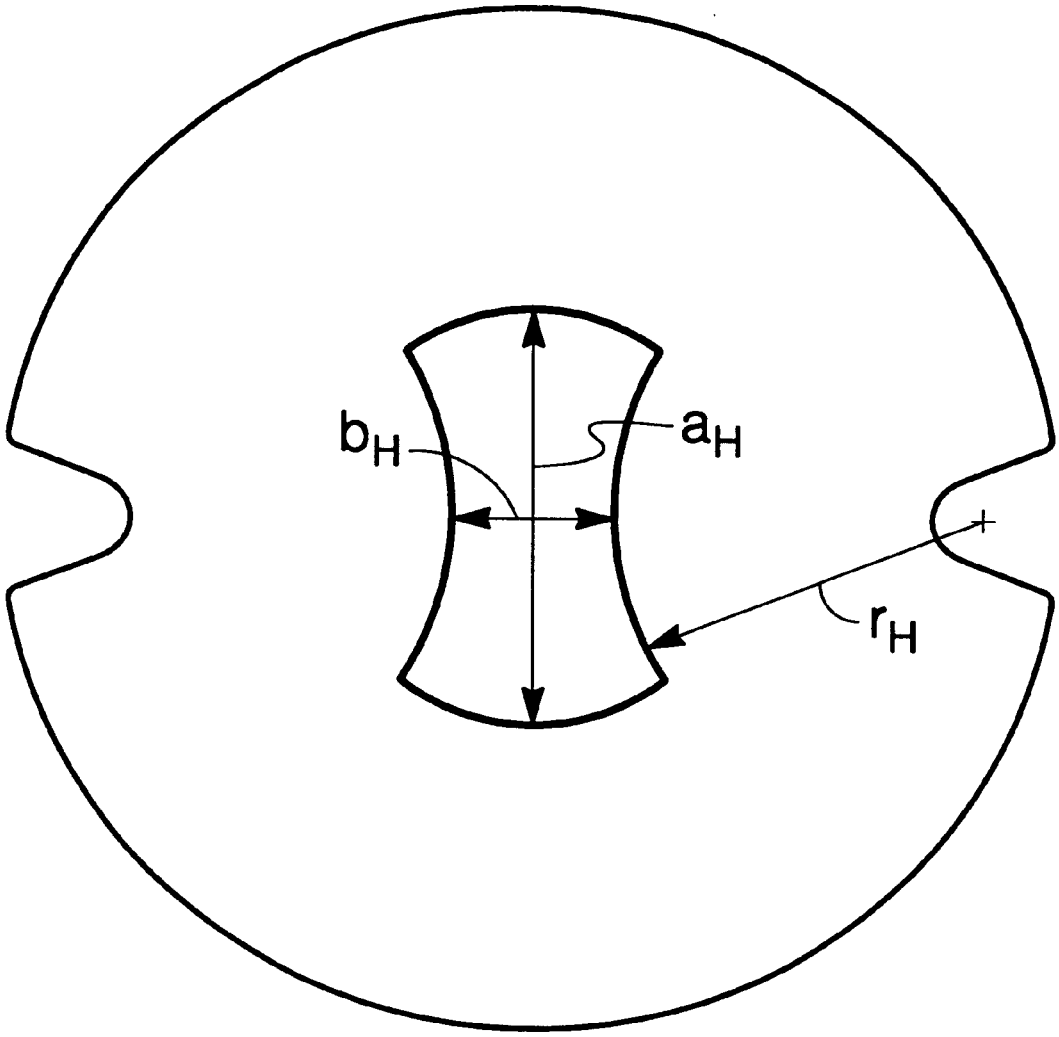
FIG. 7 is a plan view from the outside surface of the orifice plate showing an orifice surface aperture which may be employed in the present invention.

To resolve the trajectory problem of the crescent orifice aperture shape, another shape which provides symmetry is created by overlaying two crescent shapes with the limbs of the crescent facing away from each other. Such a shape is illustrated in FIG. 7. This modified orifice aperture shape has been deemed a "hourglass" shape. In the preferred embodiment, the modified minor axis ($b_H$) has been set at 26 $\mu$m while the modified major axis ($a_H$) has been established at 69 $\mu$m. The edges which define the modified minor axis have a radius of curvature ($r_H$) of approximately 47 $\mu$m . This unique orifice aperture shape preserves the narrow minor axis opening while reducing the necessary major axis dimension required for the fixed orifice aperture area. The reduced dimension major axis allows closer spacing of the orifices than could otherwise be realized with an ellipse of the same orifice aperture area. Further, the hourglass orifice aperture shape provides a symmetry about both major and minor axes and overcomes the problem of trajectory error of an ink droplet.

As previously described, the orifice plate is conventionally formed by electroplating nickel or similar metal on a mandrel and then plating the orifice plate with chemically resistant materials such as gold. Previously, it has been known to utilize a non-conductive button in the shape of the desired end result: the circular orifice aperture. In order to create an hourglass-shaped orifice opening, however, it was determined that a button having a shape much less complicated than an hourglass shape could be used. Since during electroplating the orifice plate base metal grows uniformly in each available direction from a conducting surface (including its own surface) details in the non-conducting button shape would be obscured by the growing base metal. Likewise, a detail in the button shape can be transformed into an entirely different shape as the base metal grows. Consider, again, FIG.1 in which the base metal 107 grows over the top surface of the non-conducting insulating button 105. When viewed in the plan view, a detail in the outline of the button 107 can be obscured or transformed into other shapes as the base metal 107 grows over the insulating button 105 top surface.

Figure 8:
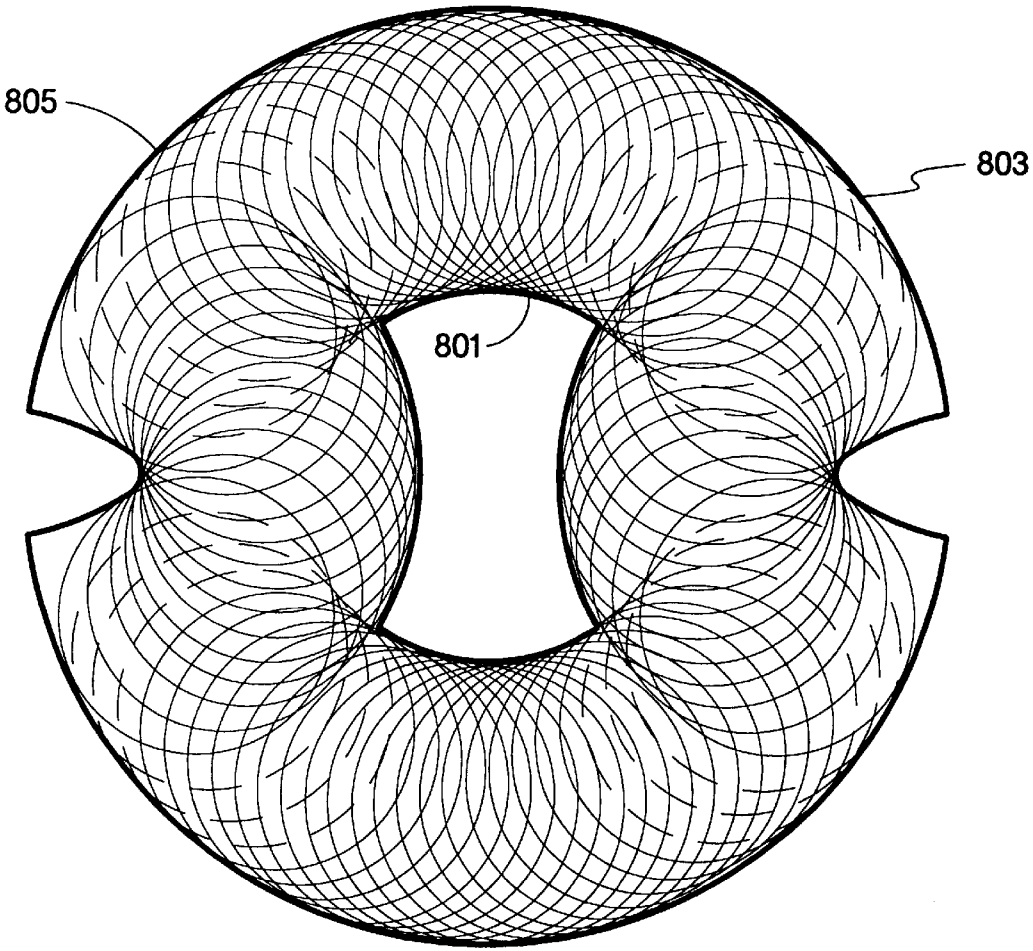
FIG. 8 illustrates a technique of forming an orifice aperture which may be employed in the present invention.

It has been found that an analysis technique utilizing a family of circles having a diameter equal to the desired base metal growth can be placed in the same plane and tangential to the outside outline of the desired orifice shape. When the point on the circumference of the circle opposite the point of tangency and sharing the same diameter line is joined to each other similar point of the family of circles, the shape the non-conducting button must take is revealed. An alternative procedure uses arcs of radii drawn from all or a representative number of points on the outside outline of the starting shape. The end point of the radius of each arc (perpendicular to a line drawn tangent to the point of the starting outline) defines a point on the orifice shape which results after the plating process is complete. Reference to FIG. 8 will aid in visualizing the technique using the family of circles.

In FIG. 8, the hourglass shape of the orifice aperture is identified as 801. A family of circles having a radius equal to the desired growth of base metal is represented by circle 803. The outline of the non-conductive button is shown as 805. Each circle of the family of circles is made tangent to the hourglass orifice shape at a point along the edge of the hourglass shape. Taking the point directly across the diameter of each circle and joining those points yields the shape of the nonconducting button. When dealing with more complex orifice shapes, it has been found that the shape of the non-conducting button does not have to be identical to the shape of the orifice. Observe that at the limbs of the hourglass shape 801, the number of circles needed to define the shape diminishes.

Figure 9:
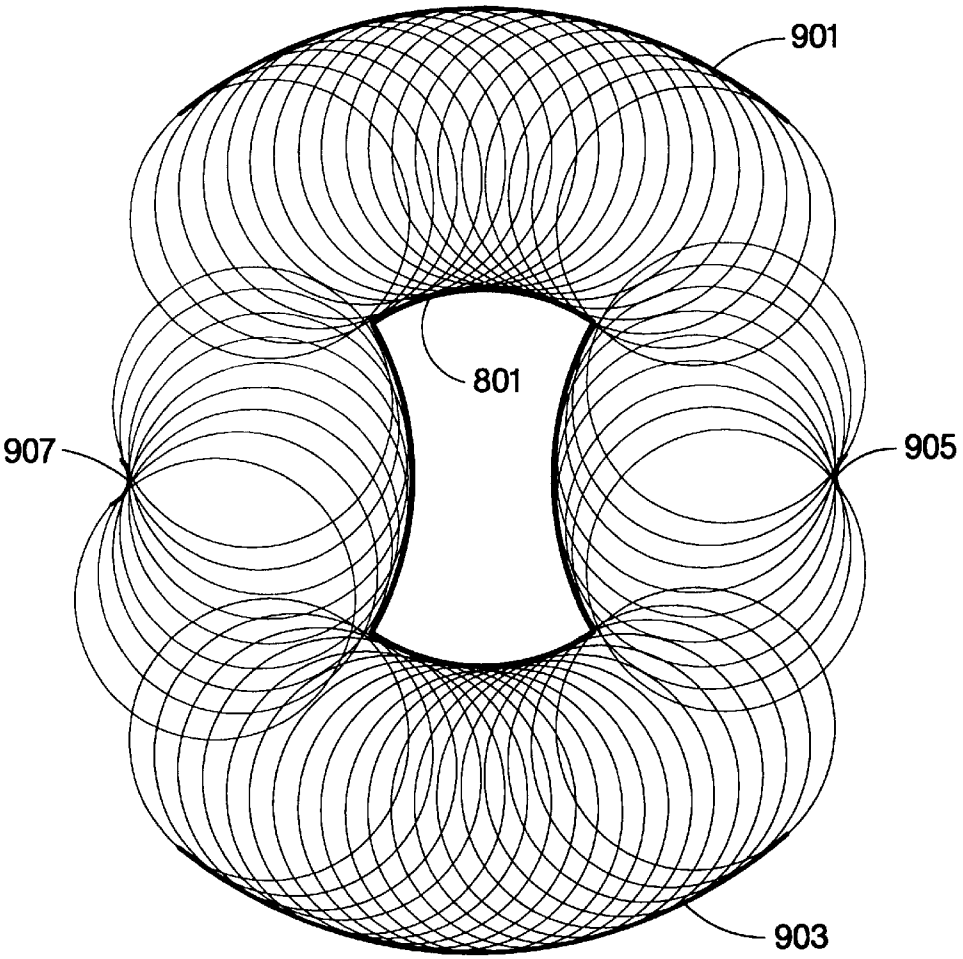
FIG. 9 illustrates a technique of forming an orifice aperture which may be employed in the present invention.

FIG. 9 illustrates the necessary construction circles needed to create the orifice opening 801. Joining the points on the circumference opposite the point of tangency yields the minimum button outline needed to produce the hourglass orifice opening desired. These outline configurations include arc 901 and arc 903 to produce the edges forming the terminals of the major axis and parabolic portions 905 and 907 to produce the edges forming the terminals of the minor axes. As long as the remainder of the button outline does not come closer to the desired orifice shape than a circle diameter, the hourglass orifice shape produced by electroplating an orifice plate will be independent of the button outline other than the identified arcs and parabolic sections.

Figure 10:
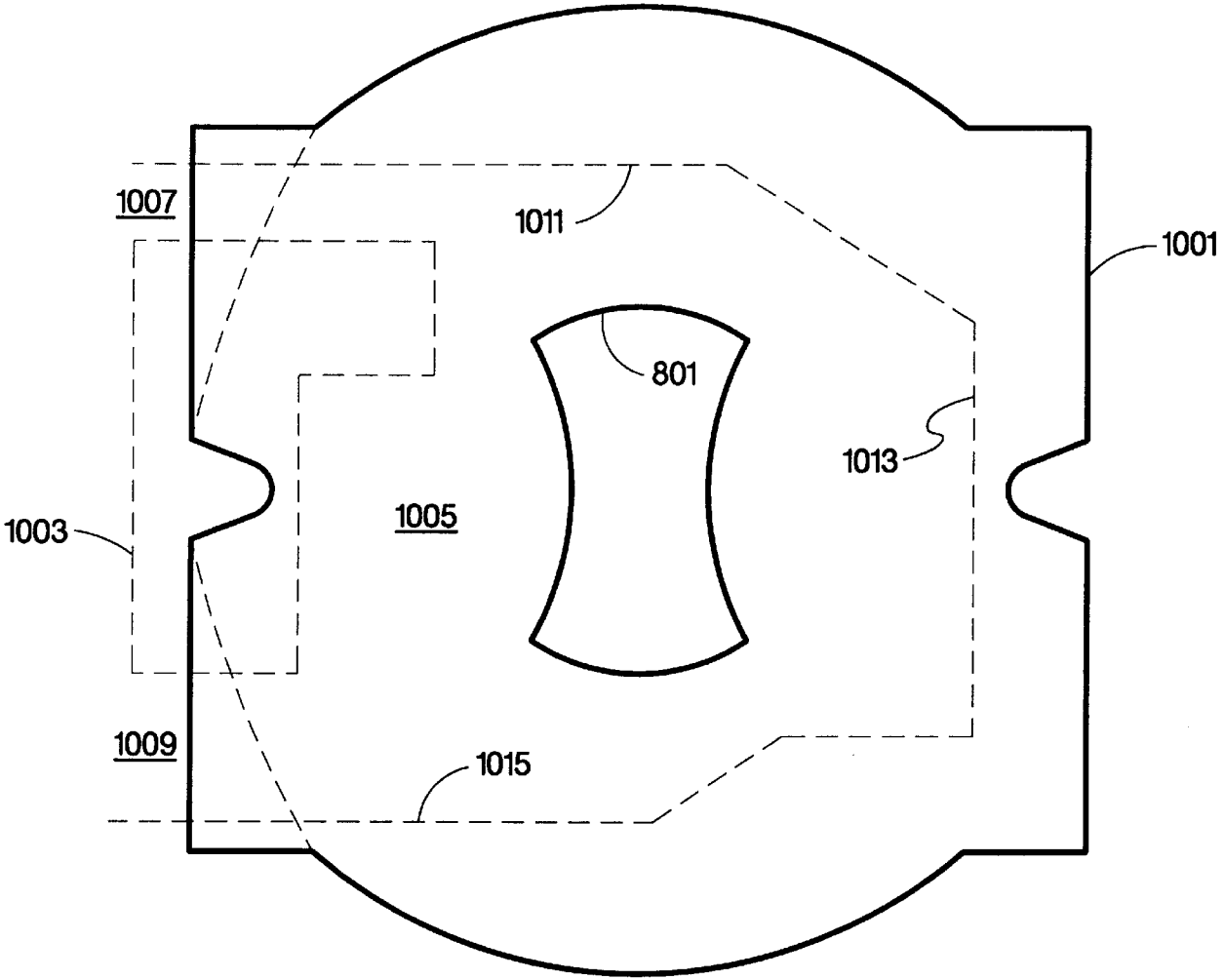
FIG. 10 is a plan view from surface of the orifice plate illustrating the orifice surface aperture and orifice bore in relation to an ink firing chamber, as may be employed in the present invention.

This outline may be used to provide improved adhesion of the orifice plate to the barrier material and allows the firing chamber to be designed with a larger volume of ink. FIG. 10 illustrates the printhead which is obtained when the non-conducting mandrel button shape is partially independent of the orifice surface hole shape. The orifice aperture 801 and the button shape 1001 are shown in solid line for the sake of clarity although the orifice aperture 801 is located on the outside surface of the orifice plate and the button shape is located on the inner surface of the orifice plate. The bore of the orifice changes from the button shape 1001 to the hourglass shaped aperture 801 as one views the orifice bore starting at the ink firing chamber and traverses to the opening at the surface of the orifice plate. In one embodiment, the configuration of the barrier layer material is shown in broken line. An island of barrier material 1003 divides the ink inlet to the firing chamber 1005 into two ink channels 1007 and 1009 and the remainder of the firing chamber 1005 is defined by walls of barrier material 1011, 1013, 1015, etc. Improved areas of contact between the barrier layer material and the orifice plate are realized in the zone around the barrier island 1003 (and illustrated with further broken line representing the hypothetical circular button outline). This improved contact area is a result of the squaring of the button shape in portions which would otherwise be circular to better match the square implementation of the barrier material and provides a rectangular cross section at the substrate which does not vary even when a misalignment of the orifice plate occurs. Further, the square implementation provides increased ink volume in the firing chamber.

In order to realize improved print quality, particularly in color applications, it is desirable to utilize closely spaced orifices for simultaneous ejection of ink from each of the closely spaced orifices. When the orifices can be spaced close enough to utilize the same firing chamber and heater resistor, appropriately coordinated droplets of ink can be ejected and complex ink marking can be accomplished on the medium. Single buttons of non-conducting material placed on the conducting mandrel have not been able to produce closely spaced firing orifices due to the required thickness of the electroformed orifice plate. It is a feature of the present invention that shaped non-conducting buttons will produce multiple orifices in a small area an area related to the size of a firing chamber.

Figure 11:
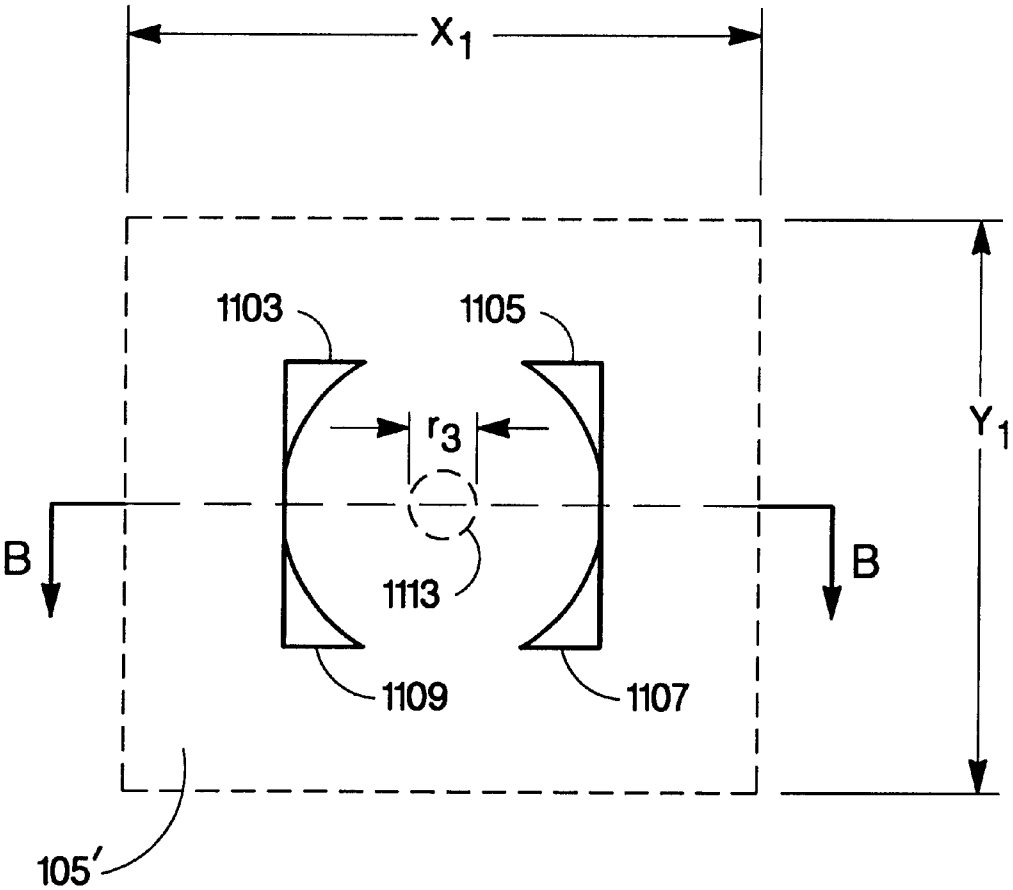
FIG. 11 is a top plan view of the orifice plate which may employ the present invention and which shows a cluster of orifices in bold line.
Figure 12:
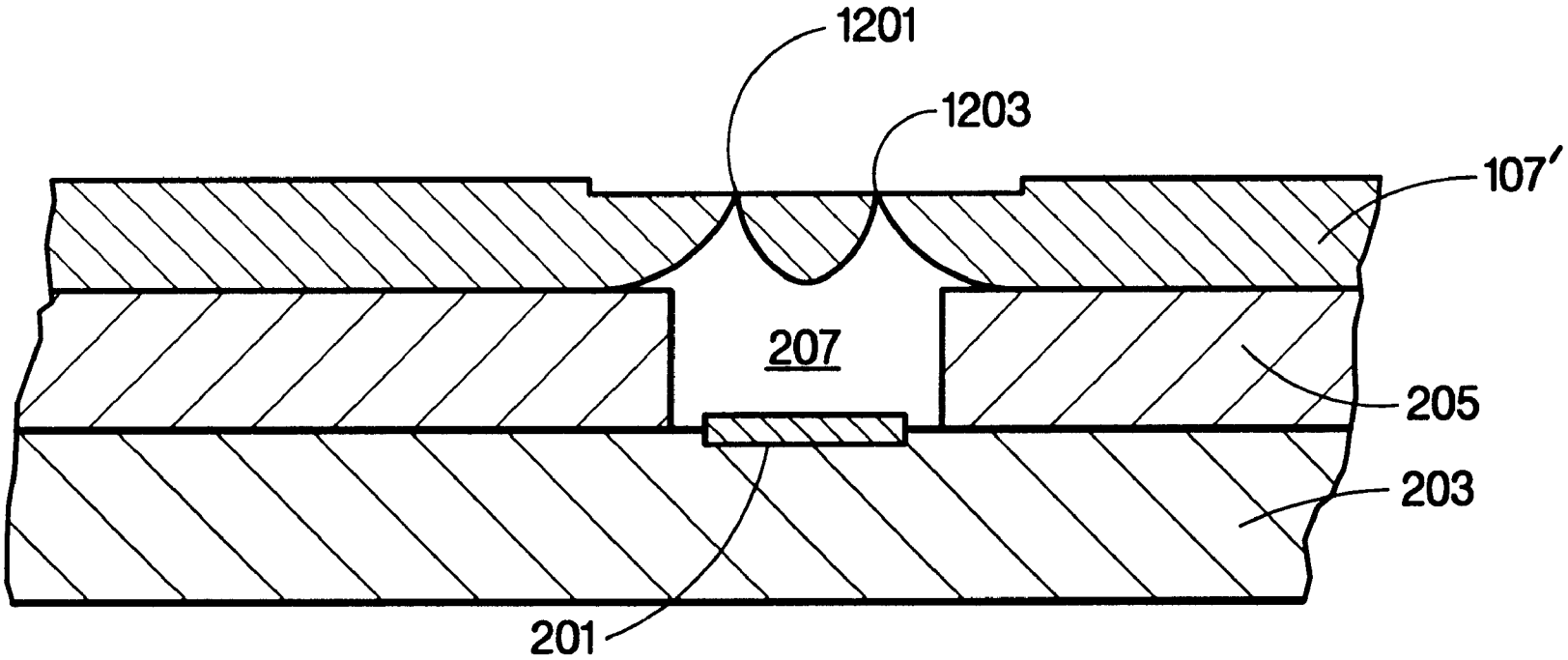
FIG. 12 is a cross section of a printhead which may employ the present invention and which shows a cross section of the orifice plate of FIG. 11 taken across section line B—B.

Turning now to FIG. 11, it can be seen that a non-conducting button having the peripheral shape of a parallelogram with a hole feature centered in the parallelogram can advantageously be used to created related and closely spaced orifices in an electrodeposited orifice plate. The view of FIG. 11 is that of the top plan view of the orifice plate showing the cluster of orifices 1101, 1103, 1105, and 1107 in bold line. Shown in broken line is the top surface of the non-conducting button upon which the four clustered orifices are formed. In one embodiment, the parallelogram-shaped button 105' has outside dimensions of $x_1$=170 $\mu$m by $y_1$=160 $\mu$m. A hole 1113 is disposed in the center of the parallelogram-shaped button and in this embodiment, has a diameter of $r_3$=10 $\mu$m. As shown in the cross section in FIG. 12, which illustrates the operational configuration of a printhead for an inkjet printer, the heater resistor 201 is disposed in the firing chamber 207 formed by the semiconductor substrate 203, the barrier material 205, and the inside surface orifice plate 107' which is equivalent to the inside surface 115 of FIG. 2. The orifice plate 107' is cross sectioned along section line BB in FIG. 11 to yield the view of FIG. 12. In this view, the electrodepositing process has joined the ends of orifices 1103 and 1109 (at 1201) and the ends of orifices 1105 and 1107 (at 1203) thereby forming independent orifices in a cluster associated with one firing chamber. When produced with an electrodeposition thickness of 40 $\mu$m, the opening area of each orifice is equal to approximately 250 $\mu m^2$.

Figure 1:
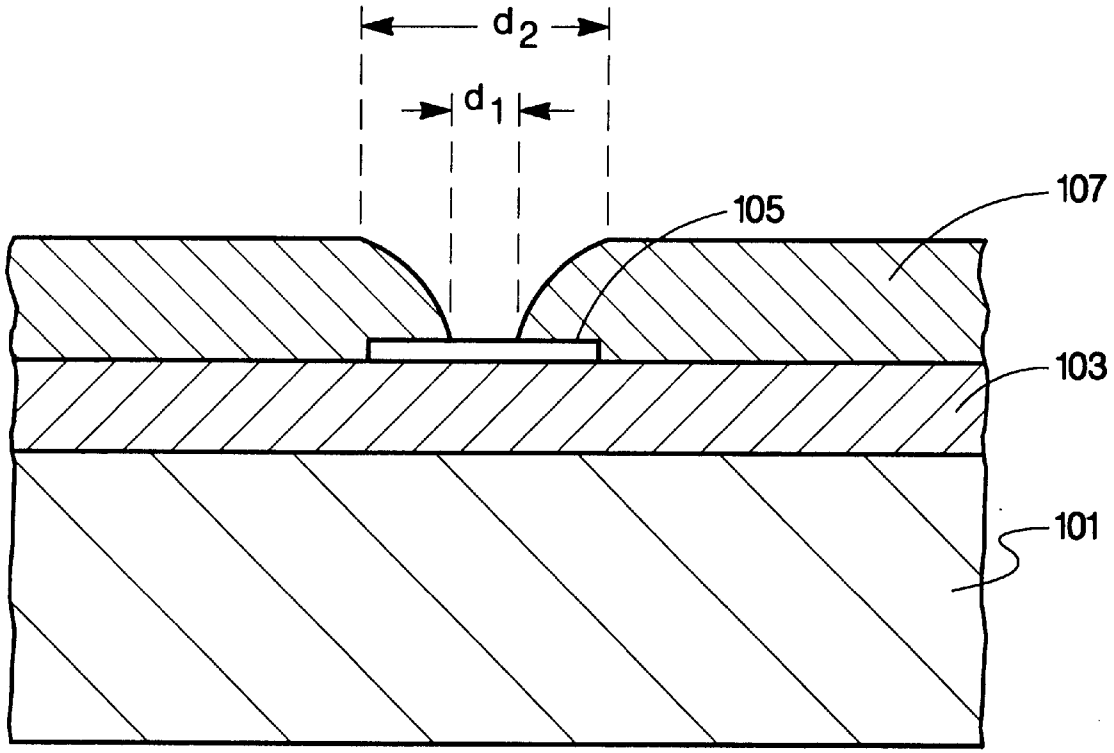
FIG. 1 is a cross section of an orifice plate forming mandrel and an orifice plate formed on the mandrel.
Figure 13:
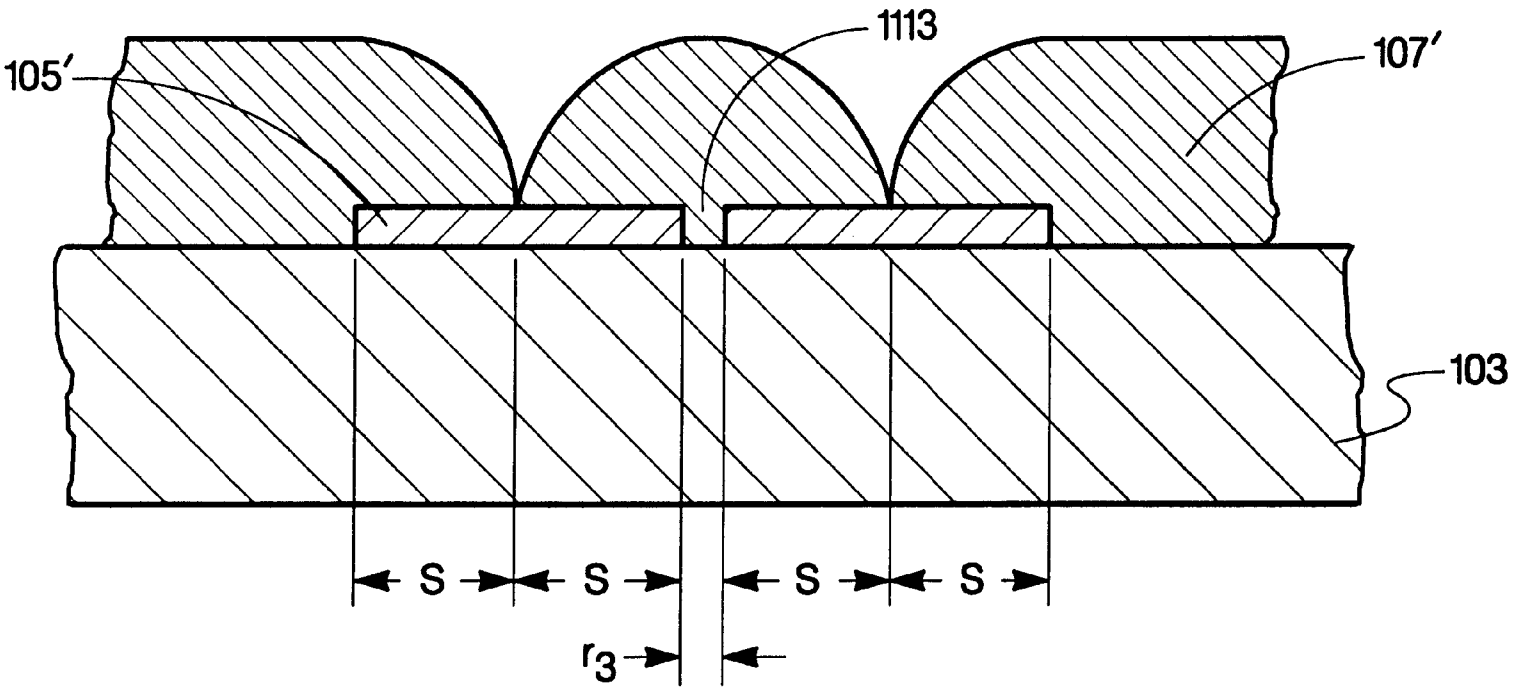
FIG. 13 is a cross section of a mandrel upon which is deposited a non-conductive button and a cross section (along section line B—B) of an electrodeposited orifice plate such as that shown in FIG. 11.

FIG. 13 shows the formation of the orifice plate 107' consistent with the process described in association with FIG. 1. In a preferred embodiment, nonconductive button 105' is deposited such that a hole 1113 is disposed within the non-conductive button. The size of the deposited non-conductive button is as shown in FIG. 11 but for analysis of this cross section, can be thought of as $r_3$ plus four sections of s=40 $\mu$m each. As shown in FIG. 13, the orifice plate is that which is sectioned along section line BB in FIG. 11 and inverted. As nickel (or other electrodeposited material) is deposited on the conductive surface of 103, it grows uniformly in each direction from the conductive surface, including the surface exposed through hole 1113, but not from the non-conducive button 105'. After a period of time the conventional electrodeposition process is halted when the nickel plating is 40 $\mu$m thick (the dimension of each section s of the non-conductive button) such that the nickel has joined at most of the areas above the non-conductive button, but the difference in shape of the periphery of the non-conductive button and the interior hole has caused gaps to remain in the nickel orifice plate. These gaps produce independent but associated orifices which are disposed opposite each other with a midpoint of distance between the orifices located at the center of the hole in the nonconducting button. The associated orifices have congruent areas of opening in the outer surface of the orifice plate and are symmetrical with each other about the midpoint of distance. For example, in FIG. 11 orifice 1103 and orifice 1107 are opposite each other about the midpoint between the two orifices (which is equivalent to the location of the hole 1113 in the non-conductive button) and have symmetrical and congruent areas opening onto the surface of the orifice plate. That is, a point in the area of orifice opening of orifice 1103 will have a corresponding point in the orifice opening of orifice 1107 found on an imaginary line drawn between the two points and including the midpoint between the orifices.

Figure 14:
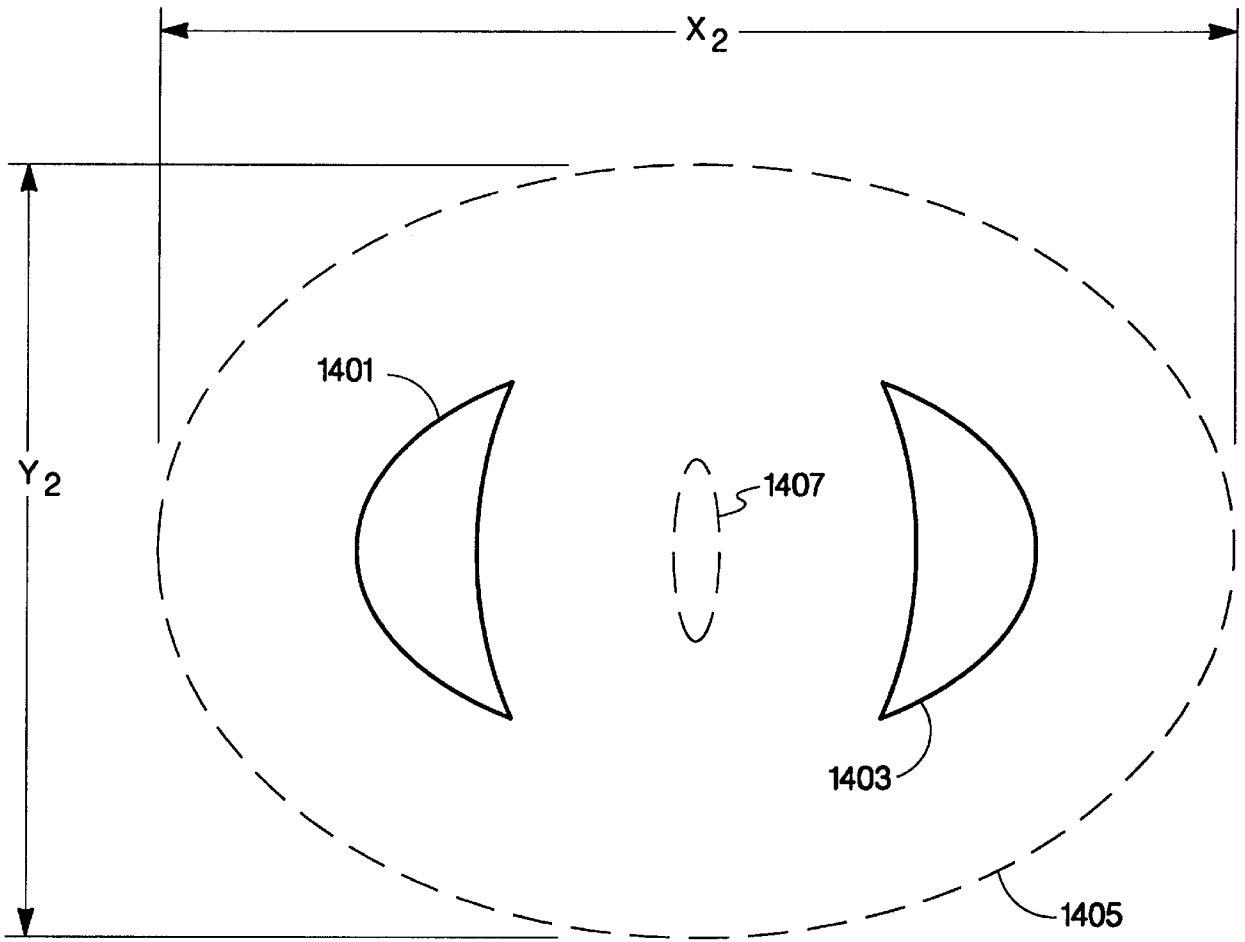
FIG. 14 is a top plan view of a portion of an orifice plate for a printhead showing two orifices and which may employ the present invention.

The parallelogram of FIG. 11 is not the only configuration which could be used to created multiple orifices in a printhead. Several examples have been considered in some detail and are discussed in conjunction with FIGS. 14–18B. FIG. 14 illustrates two "D"-shaped associated orifice openings, 1401 and 1403, at the surface of the orifice plate. These two ink-ejecting orifices are created by employing an elliptical non-conducting button (shown in broken line as an elliptical periphery of a button 1405) which has an elliptical hole 1407 centered at the junction of the major and minor axes of the non-conductive button. The shape difference between the hole in and the periphery of the non-conductive button is created by orienting the major axis of the cross section of the hole with the minor axis of the button. As the electrodepositing process is used and terminated, the shape difference yields spaces as shown in FIG. 14. In a preferred embodiment, the major axis of the nonconductive button 1405 is set at $x_2$=220 $\mu$m and the minor axis is set at $y_2$=160 $\mu$m. The major axis of the hole 1407 in the button is set at 40 $\mu$m and the minor axis is set at 10 $\mu$m. The conventional electrodeposition process is run for a duration to enable the nickel plating to develop to a thickness of 40 $\mu$m. The end result is that the two orifices 1401 and 1403 each have an area of opening equal to about 1000 $\mu m^2$.

Figure 15:
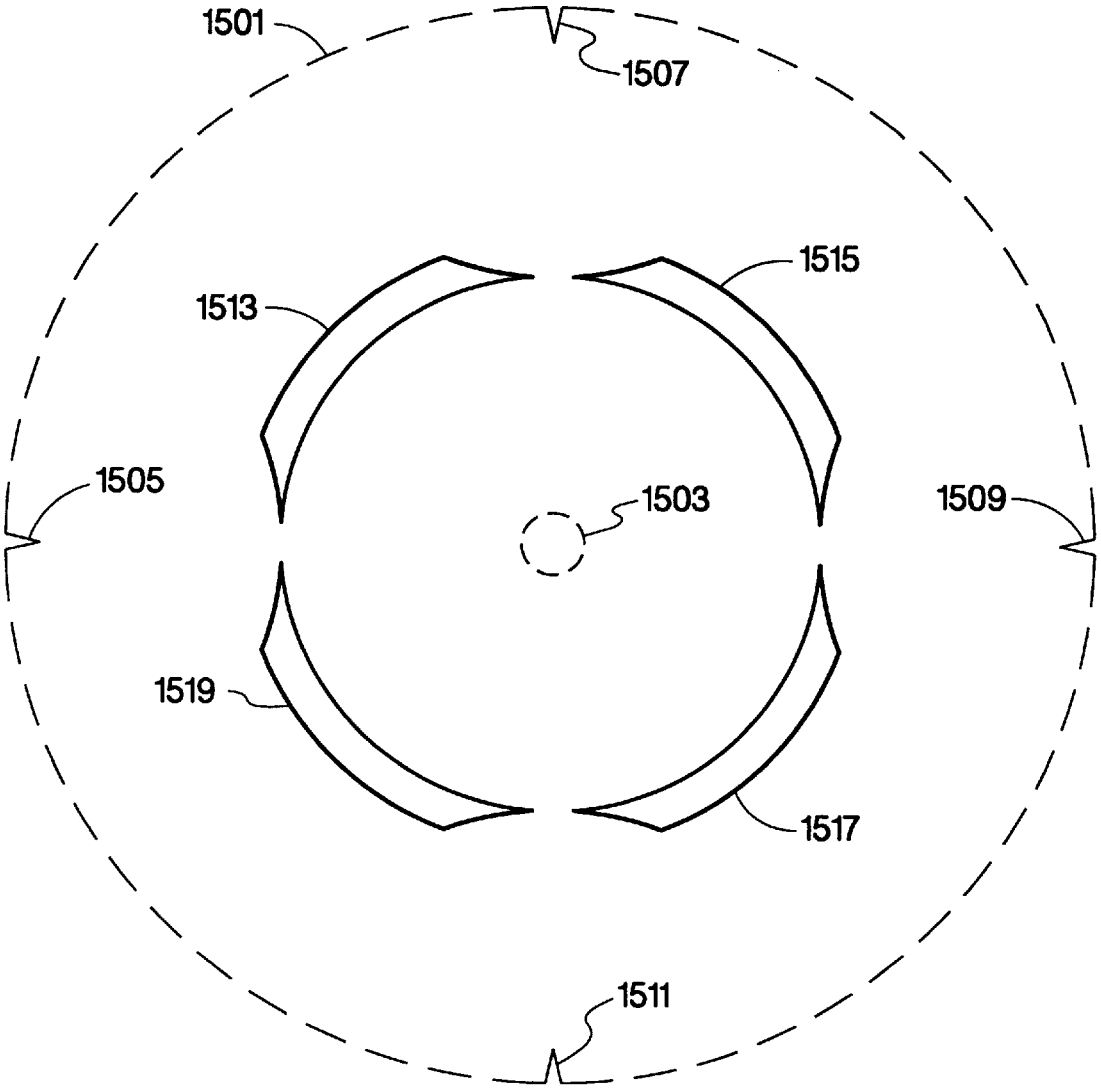
FIG. 15 is a top plan view of a portion of an orifice plate for a printhead showing four orifices in the form of slits and which may employ the present invention.

FIG. 15 illustrates a four orifice cluster which is produced by a circular nonconductive button 1501 having a concentric circular hole 1503. The circumference of the button has as features in the peripheral outline of the non-conductive button four notches 1505, 1507, 1509, and 1511 which enable electrodeposition growth from the conductive surface beneath the notches onto the surface of the nonconductive button. This notch-growth produces a metallic incursion onto the surface of the non-conductive button which yields a separation between an orifice cluster of four orifices. These four orifices, 1513, 1515, 1517, and 1519, are narrow slits of approximately 175 $\mu m^2$ area when the non-conductive button has a diameter of 160 $\mu$m, the center hole has a diameter of 10 $\mu$m, and the electrodeposition process is halted when the thickness of the orifice plate has reached a thickness of 35 $\mu$m.

Figure 16:
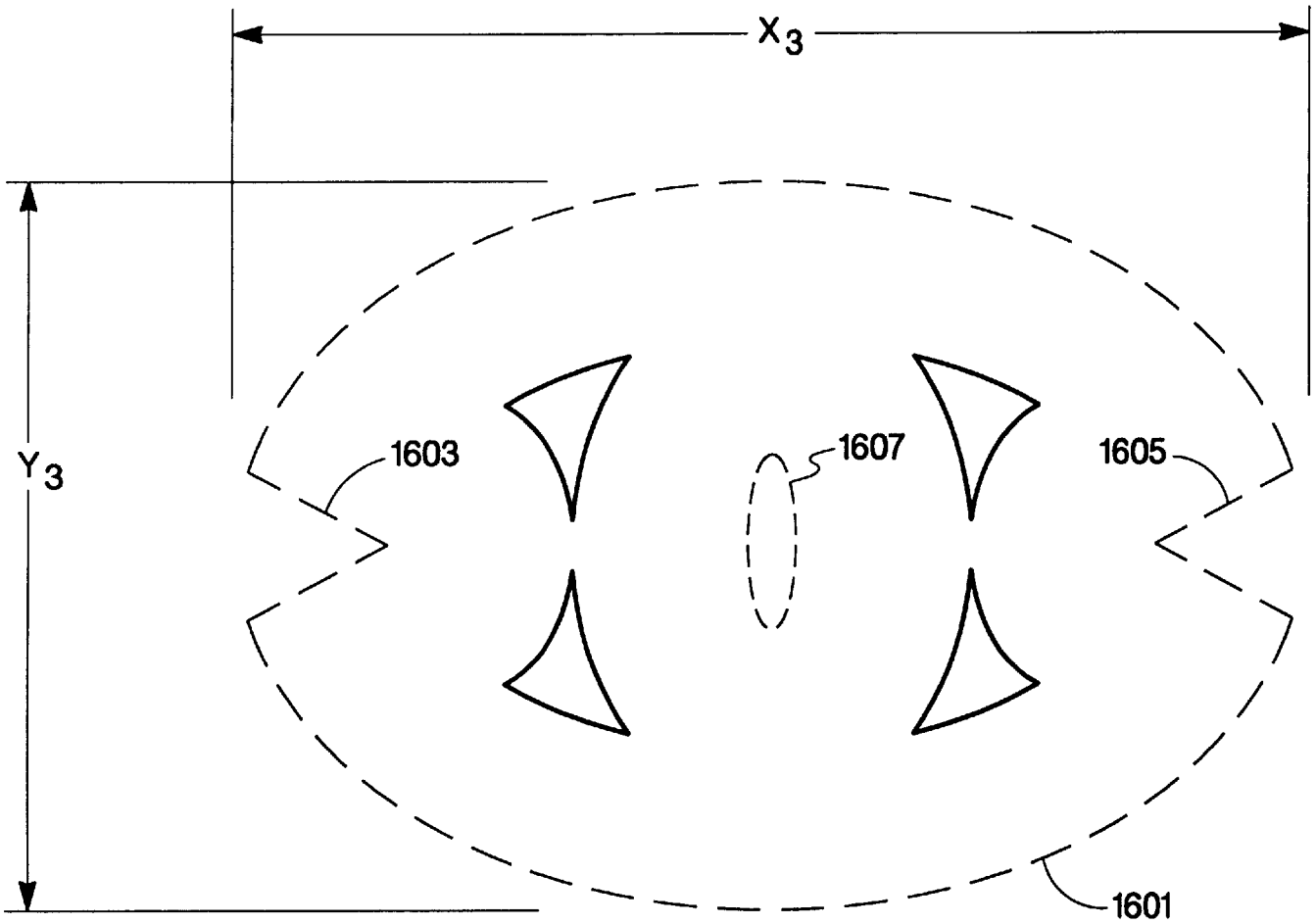
FIG. 16 is a top plan view of a portion of an orifice plate for a printhead showing four orifices and which may employ the present invention.
Figure 17:
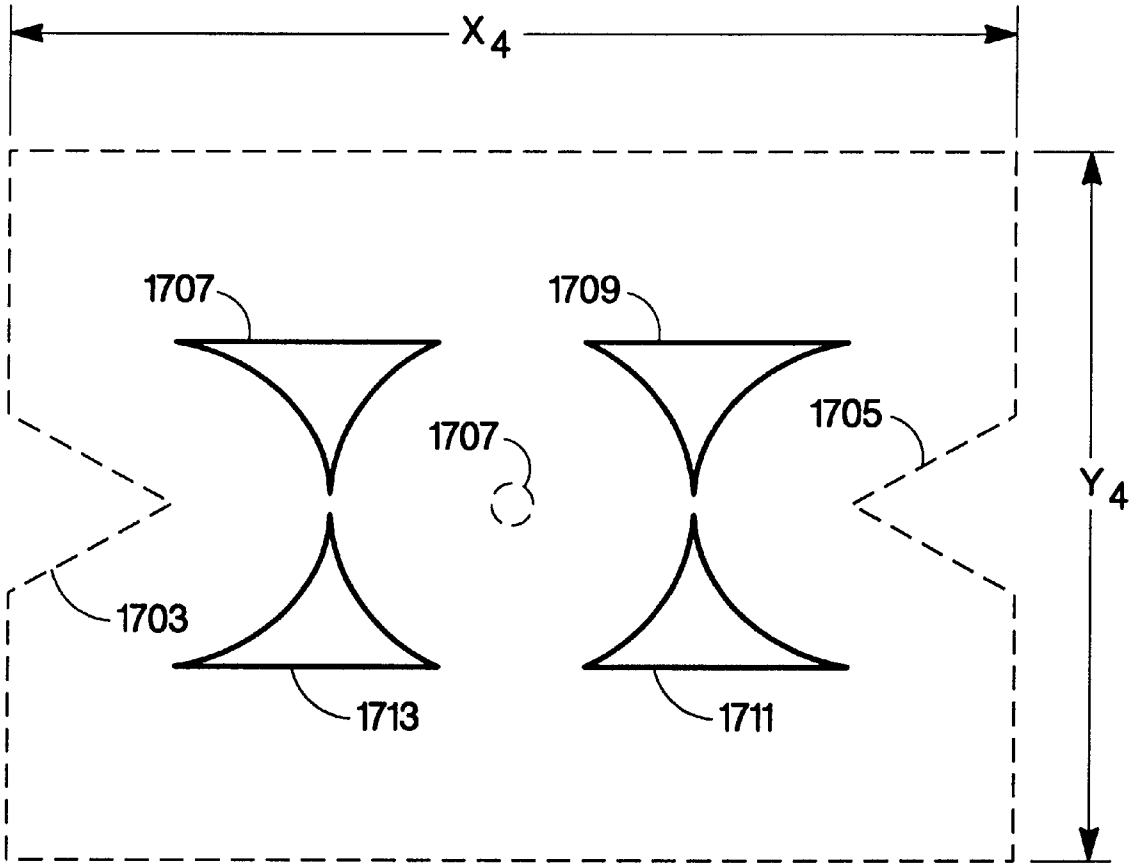
FIG. 17 is a top plan view of a portion of an orifice plate for a printhead showing four orifices and which may employ the present invention.

FIG. 16 illustrates a four orifice cluster at the outside surface of the orifice plate which is produced by a non-conductive button (shown in broken line as 1601) having an elliptical peripheral shape with notch features 1603 and 1605 exposing the conductive surface beneath the non-conductive button and placed at the ends along the major axis. An elliptical hole 1607, with the axes rotated relative to those of the button, is placed at the center of the button. When the major axis of the elliptical button made equal to $x_3$=240 $\mu$m and the minor axis made equal to $y_3$=160 $\mu$m, the notches indented from the periphery of the non-conductive button by 35 $\mu$m, and the elliptical hole through the non-conductive button (to the conductive surface beneath) made equal to 10 $\mu$m by 40 $\mu$m, the opening area at the outside surface of the orifice plate of each orifice of the cluster is approximately 100 $\mu m^2$.

Several variations can be made to the design shown in FIG. 16. An example is to use a non-conductive button 1701 in the shape of a rectangle having notches 1703, 1703 in the short sides of the rectangle and a circular hole 1707 in the center. When the long side dimension of the non-conductive button is set at $X_4$=240 $\mu$m, the short side dimension of the button is set at $y_4$=160 $\mu$m, the notches are cut in from the short sides by 35 $\mu$m, the diameter of the circular hole is set to 10 $\mu$m, and the electrodeposition process is run until the nickel plating is 40 $\mu$m thick, four orifices 1707, 1709, 1711, and 1713 are formed having an opening area of approximately 250 $\mu m^2$ each. It is anticipated that the rectangular non-conductive button of FIG. 17 can utilize an elliptical hole and that the elliptical non-conductive button of FIG. 16 can utilize a circular hole.

Figure 18A:
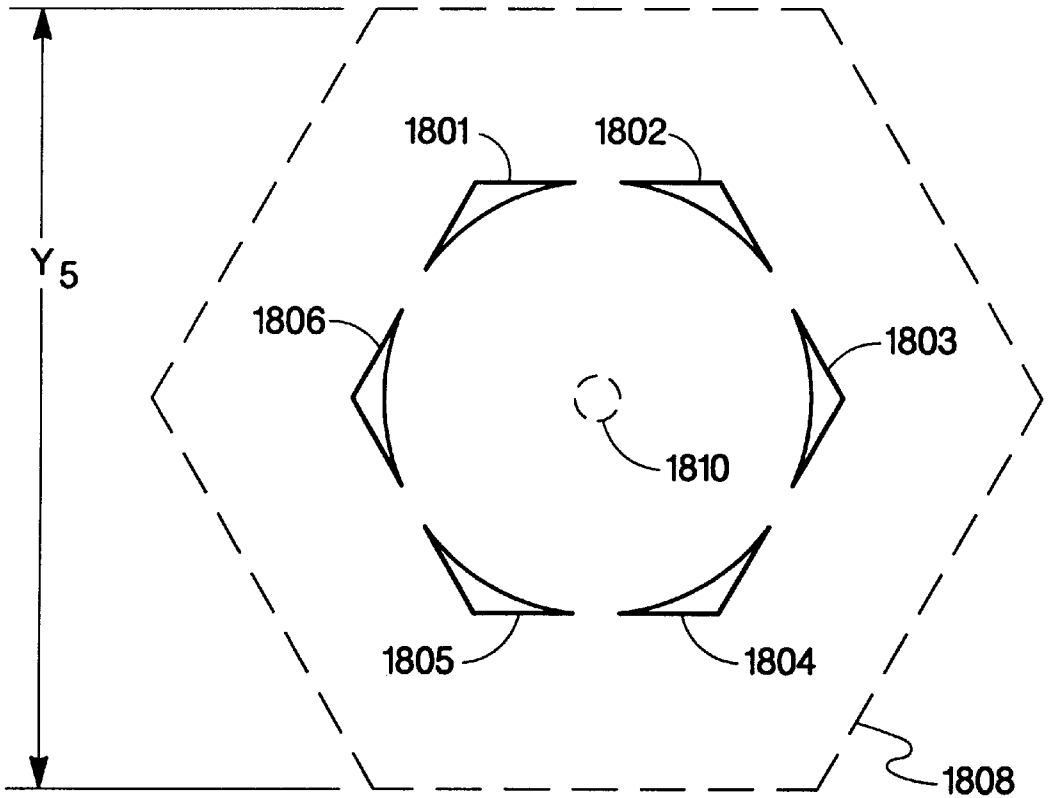
FIGS. 18A and 18B are a top plan views of an orifice plate for a printhead showing six orifices and which may employ the present invention.
Figure 18B:
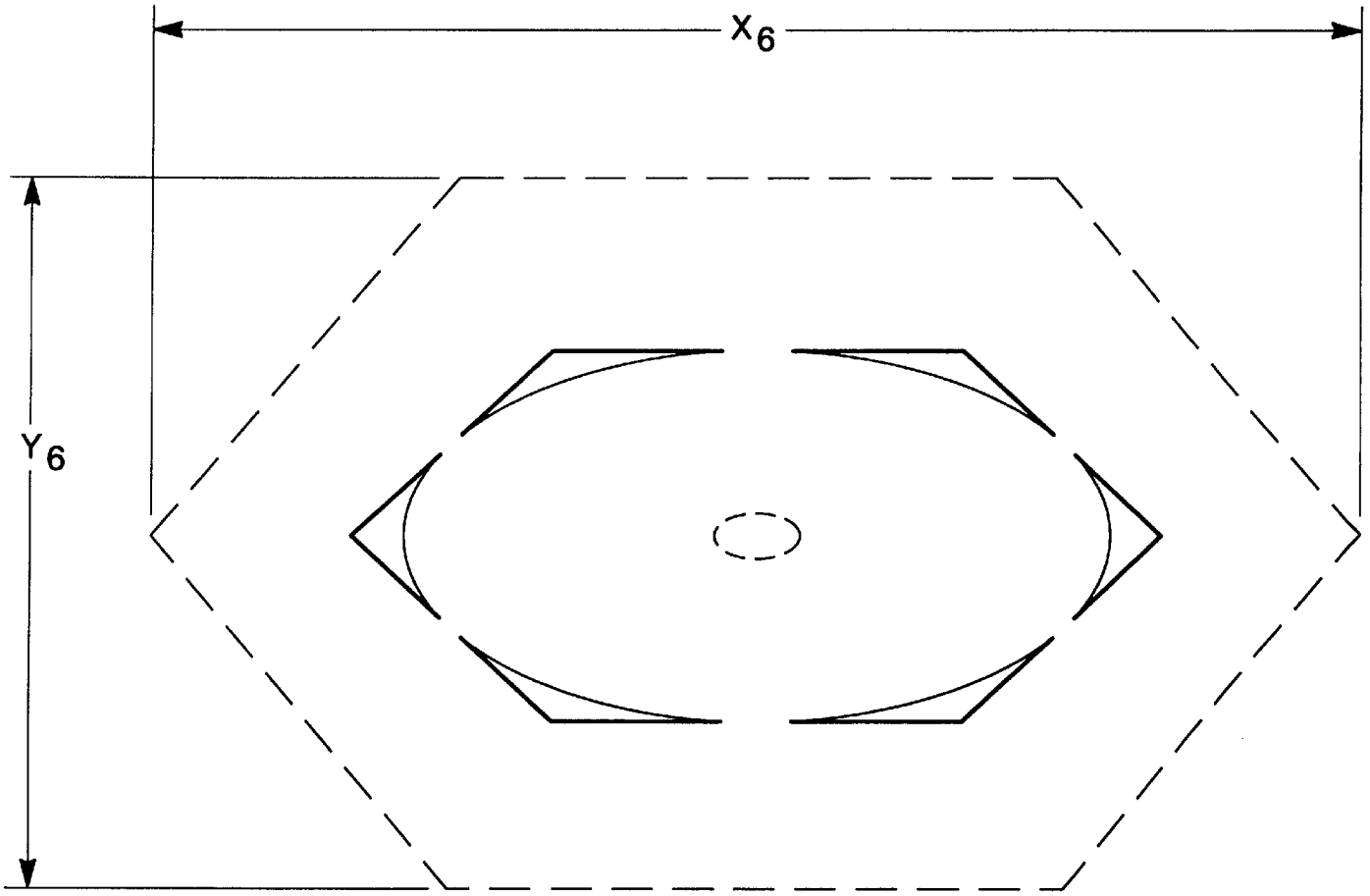

An orifice cluster of more than four orifices can be produced with nonconductive buttons having other geometric shapes and a hole. Six clustered orifices, 1801–1806, can be created with a non-conductive button in the shape of a hexagon (shown in broken line in FIG. 18A as 1808) having a centered hole 1810 to the conductive surface. When the dimension of the hexagonal button is set to $y_5$=160 $\mu$m, the hole is created to be 10 $\mu$m, and the electrodeposition process creates a nickel thickness of 37.5 $\mu$m, each orifice opening area becomes approximately 100 $\mu m^2$. As an alternative, the button can be distorted in one or more dimensions, as shown in FIG. 18B. One button dimension is set to $y_6$=160 $\mu$m and another is set at $x_6$=220 $\mu$m. An elliptical hole of 10 $\mu$m by 55 $\mu$m is centered in the distorted hexagon. When the electrodeposition process creates an orifice plate thickness of 37.5 $\mu$m, the opening area of each of the clustered orifices is 100 $\mu m^2$.

Thus, in accordance with the foregoing, it can be seen that a closely spaced cluster of orifices is created with a single non-conductive button having a controlled shape and a shaped hole in the button. This arrangement produces independent but coordinated orifices which are particularly useful in producing high quality images.

What is claimed is:

1. A printhead for an inkjet printing apparatus comprising an orifice plate having at least two ink ejection orifices disposed to be activated simultaneously with each other and disposed opposite each other with a midpoint of distance between them, each one of said at least two orifices having a geometric area which is symmetrical with the other about said midpoint of distance.

2. A printhead in accordance with claim 1 wherein said at least two orifices each further comprise a non-circular orifice.

3. A printhead in accordance with claim 1 wherein said printhead further comprises a heater resistor associated with said at least two orifices and an ink firing chamber disposed between said heater resistor and said orifice plate such that ink will be expelled from both said at least two orifices when said heater resistor is energized with sufficient energy to vaporize some of the ink.

4. A printhead for an inkjet printing apparatus comprising:

an ink firing chamber created by a plurality of surfaces;

an ink ejector disposed on one of said plurality of surfaces within said ink firing chamber;

an orifice plate having an inside surface and an outside surface, said inside surface forming at least one surface of said plurality of surfaces of said ink firing chamber; and at least two non-circular orifices disposed through said orifice plate from said outside surface to said inside surface, said at least two non-circular orifices opening into said firing chamber and disposed to be simultaneously activated by said ink ejector.

5. A printhead in accordance with claim 4 wherein each of said two non-circular orifices further comprise congruently shaped openings on said outside surface of said orifice plate.

6. A method of forming a foraminous plate for an inkjet printing apparatus, comprising the steps of:

disposing on a conductive surface a layer of non-conductive material having a periphery of predetermined shape and at least one feature exposing said conductive surface encompassed by said periphery; and depositing a layer on said conductive substrate, said layer having a thickness and extending onto said non-conductive material from said periphery and said at least one feature by a distance essentially equal to said thickness such that at least two orifices are thereby created through said thickness in the deposited layer.

7. A method of forming a foraminous plate in accordance with the method of claim 6 wherein said disposing a layer of non-conductive material step further comprises the step of forming said periphery as a parallelogram.

8. A method of forming a foraminous plate in accordance with the method of claim 6 wherein said step of disposing a layer of non-conductive material further comprises the step of forming said at least one feature as a hole with a circular cross section centered in said layer of non-conductive material.

9. A method of forming a foraminous plate in accordance with the method of claim 6 wherein said step of disposing a layer of non-conductive material further comprises the step of forming said periphery as an ellipse with a hole centered at the intersection of the major axis and the minor axis of said ellipse.

10. A method of forming a foraminous plate in accordance with the method of claim 9 wherein said step of disposing a layer of non-conductive material further comprises the step of forming said centered hole with an elliptical cross section and disposed with the major axis of said elliptical cross section aligned with said minor axis of said elliptical conductive button.

11. A method of forming a foraminous plate in accordance with the method of claim 6 wherein said step of disposing a layer of non-conductive material further comprises the step of forming said periphery into a linear-sided geometric shape.

12. A method of forming a foraminous plate in accordance with the method of claim 11 wherein said step of disposing a layer of non-conductive material further comprises the step of forming said at least one feature as a centered hole with a circular cross section.

13. A foraminous plate for an inkjet printer created by the method of claim 6.

14. A method of constructing a printhead for an inkjet printing apparatus, comprising the steps of:

forming an orifice plate having at least two ink ejection orifices disposed to be activated simultaneously with each other; and disposing said at least two ink ejection orifices opposite each other with a midpoint of distance between them, each one of said at least two orifices having a geometric area which is symmetrical with the other about said midpoint of distance.

15. A method of constructing a printhead in accordance with claim 14 further comprising the steps of:

disposing a heater resistor associated with said at least two orifices on a substrate;

forming an ink firing chamber about said heater resistor; and attaching said orifice plate to said ink firing chamber such that ink will be expelled simultaneously from said at least two orifices when said heater resistor is energized with sufficient energy to vaporize some of the ink.

* * * * *